US007905477B2

(12) United States Patent
Saitsu

(10) Patent No.: US 7,905,477 B2
(45) Date of Patent: Mar. 15, 2011

(54) INTERMEDIATE CONVEYING APPARATUS

(75) Inventor: Yasushi Saitsu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 422 days.

(21) Appl. No.: 12/098,865

(22) Filed: Apr. 7, 2008

(65) Prior Publication Data

US 2008/0296826 A1 Dec. 4, 2008

(30) Foreign Application Priority Data

May 29, 2007 (JP) ..... 2007-141434

(51) Int. Cl.
*B65H 37/04* (2006.01)

(52) U.S. Cl. ..... 270/58.1; 270/58.07; 270/58.09; 270/58.11

(58) Field of Classification Search ..... 270/58.1, 270/58.07, 58.08, 58.09, 58.11
See application file for complete search history.

(56) References Cited

U.S. PATENT DOCUMENTS

| | | | | |
|---|---|---|---|---|
| 5,443,248 | A * | 8/1995 | Hayashi et al. | 270/58.09 |
| 6,296,247 | B1 * | 10/2001 | Tamura et al. | 271/214 |
| 6,308,948 | B1 * | 10/2001 | Azumi | 271/207 |
| 7,413,181 | B2 * | 8/2008 | Iida et al. | 270/58.12 |

FOREIGN PATENT DOCUMENTS

| | | |
|---|---|---|
| JP | 10-250914 | 9/1996 |
| JP | 2003-002503 | 1/2003 |
| JP | 2003-054809 | 2/2003 |
| JP | 2005-015225 | 1/2005 |

* cited by examiner

*Primary Examiner* — Leslie A Nicholson, III
(74) *Attorney, Agent, or Firm* — Finnegan, Henderson, Farabow, Garrett & Dunner, L.L.P.

(57) ABSTRACT

A conveyance control device of an intermediate conveying apparatus calculates the number of sweets finished in terms of processing, based on information about the number of superposed sheets for one set and about the number of sets finished in terms of processing received from the post-processing apparatus, and controls to transmit the calculated number of sheets to the aforesaid image forming apparatus.

5 Claims, 14 Drawing Sheets

FIG. 10 (a)

PAGE CONTROL INFORMATION TABLE

| PAGE ID |
|---|
| 1 |
| 2 |
| 3 |
| 4 |
| 5 |
| ... |

q3 q4

SUPERPOSITION CONTROL INFORMATION TABLE

| PAGE ID | NUMBER OF SUPERPOSED SHEETS |
|---|---|
| 1 | 2 |
| 3 | 2 |
| 5 | 1 |
| ... | ... |

q2

PAGE ID RECEIVED FROM POST-PROCESSING APPARATUS

| PAGE ID |
|---|
| 1 |

q1

PAGE ID TO BE SENT TO IMAGE FORMING APPARATUS

| PAGE ID |
|---|
| 1 |
| 2 |

FIG. 10 (b)

| PAGE ID |
|---|
| 3 |
| 4 |
| 5 |
| ... |

| PAGE ID | NUMBER OF SUPERPOSED SHEETS |
|---|---|
| 3 | 2 |
| 5 | 1 |
| ... | ... |

| PAGE ID |
|---|
| 3 |

| PAGE ID |
|---|
| 3 |
| 4 |

FIG. 10 (c)

| PAGE ID |
|---|
| 5 |
| ... |

| PAGE ID | NUMBER OF SUPERPOSED SHEETS |
|---|---|
| 5 | 1 |
| ... | ... |

| PAGE ID |
|---|
| 5 |

| PAGE ID |
|---|
| 5 |

FIG. 14

PAGE CONTROL INFORMATION TABLE

| PAGE ID |
|---|
| 1 |
| 2 |
| 3 |
| 4 |
| 5 |
| ... |

SUPERPOSITION CONTROL INFORMATION TABLE

| PAGE ID(x) | NUMBER OF SUPERPOSED SHEETS "N" |
|---|---|
| 1 | 2 |
| 3 | 2 |
| 5 | 1 |
| ... | ... |

q13 q14

BUNDLE CONTROL INFORMATION TABLE

| PAGE ID(y) | NUMBER OF TIMES OF SUPERPOSITION "M" |
|---|---|
| 1 | 3 |

q12 q11

INTERMEDIATE CONVEYING APPARATUS

This application is based on Japanese Patent Application No. 2007-141434 filed on May 29, 2007 in Japanese Patent Office, the entire content of which is hereby incorporated by reference.

BACKGROUND OF THE INVENTION

The present invention relates to an intermediate conveying apparatus that superposes plural sheets conveyed from an image forming apparatus and conveys the superposed sheets to a subsequent post-processing apparatus while the plural sheets are superposed.

In recent years, an image forming apparatus of an electrophotographic type has been used in a field of quick printing. Further, bookbinding printing of a print-on-demand type "for printing copies in necessary quantity only when needed" is made possible by using an image forming apparatus equipped with a post-processing apparatus that conducts various types of post-processing operations.

In addition, efficiency improvement of bookbinding operations and cost reduction are greatly expected, because no preparation of a printing plate is needed.

The image forming system disclosed in Japanese Patent Publication Open to Public Inspection No. 2005-15225 represents an apparatus wherein the aforesaid demands are satisfied, and it is an image forming system wherein a single sheet processor that is a type of a post-processing apparatus is connected on the sheet ejection side of an image forming apparatus, and at least one type of post-processing apparatus out of plural types of post-processing apparatuses is further connected to the single sheet processor.

Further, in the image forming apparatus and in the image forming system wherein a post-processing apparatus is connected to the image forming apparatus, it is demanded that the number of processed sheets per unit of time (hereinafter referred to as productivity) is large. In the field of quick printing, in particular, that demand is strong. And in many cases, the number of processed sheets in the image forming system is determined by a capacity of the post-processing apparatus rather than that of the image forming apparatus.

Namely, in the post-processing apparatus, it is necessary to secure a sufficient distance of an interval between successive sheets (hereinafter referred to as a sheet interval), because there are many cases where conveyance of sheets is temporarily stopped for processing. As measures for that purpose, a conveyance speed in the post-processing apparatus is increased to be higher than that in the image forming apparatus. However, a speed increase for the conveyance speed in the post-processing apparatus is close to the limit, because the conveyance speed for the image forming apparatus has been raised due an attempt of speeding up in recent years.

With the foregoing as a background, each of Japanese Patent Publication Open to Public Inspection Nos. 10-250914, 2003-2503 and 2003-54809 discloses an apparatus wherein an intermediate storing section that stacks plural sheets in an image forming apparatus or in a subsequent post-processing apparatus is provided, and plural sheets stacked on an stacking section are conveyed together simultaneously. By conveying these plural superposed sheets simultaneously like this, it is possible to broaden sheet intervals by an equivalent of the superposed sheets without increasing the conveyance speed, namely, it is possible to improve productivity in the post-processing apparatus.

However, in the case of the apparatus described in Japanese Patent Publication Open to Public Inspection No. 10-250914 or in Japanese Patent Publication Open to Public Inspection No. 2003-54809, it is necessary to provide an intermediate storing section on each of post-processing apparatuses when connecting plural types of post-processing apparatuses as in Japanese Patent Publication. Open to Public Inspection No. 2005-15225, because an intermediate storing section is provided in the post-processing apparatus.

In the apparatus described in Japanese Patent Publication Open to Public Inspection No. 2003-2503, an unnecessary apparatus is provided when using an image forming apparatus without connecting the post-processing apparatus, because an intermediate storing section is provided in the image forming apparatus.

SUMMARY

An aspect of the invention is as follows.

(1) An intermediate conveying apparatus superposing plural sheets conveyed from an image forming apparatus, then, storing them temporarily in an intermediate storing section, and conveying plural superposed sheets as one set to a subsequent post-processing apparatus that conducts post processing on the sheets, wherein a communication device that conducts data communication with the image forming apparatus and the post-processing apparatus and a conveyance control device that controls sheet conveyance are provided, and the conveyance control device calculates the number of processed sheets based on information of the number of superposed sheets in one set and information of the number of processed sets received from the post-processing apparatus, and sends information about the calculated number of sheets to the aforesaid image forming apparatus.

(2) An image forming system including an image forming apparatus, the intermediate conveying apparatus described in Item (1) and a post-processing apparatus, wherein the post-processing apparatus can conduct post processing so as to process a plurality of sets of the superposed sheets as one bundle, and when conducting the post-processing so as to process the plurality of sets of the superposed sheets as one bundle, according to conveyance of the sheets to the post-processing apparatus, the conveyance control device sends information about page IDs of the conveyed sheets to the image forming apparatus, and according to an end of the post-processing to the bundle in the post-processing apparatus, the conveyance control device sends a notice of processing end and information about a number of the sheets for which the post-processing has ended and page ID of a first page of the bundle to the image forming apparatus.

BRIEF DESCRIPTION OF THE DRAWINGS

FIGS. 10(*a*)-(*c*) are ones exemplifying a control information table controlled by a conveyance control device of intermediate conveying apparatus B.

FIG. 14 is one exemplifying a control information table.

DETAILED DESCRIPTION OF THE PREFERRED EMBODIMENT

The present invention will be described based on an embodiment to which, however, the invention is not limited.

Figure 1:
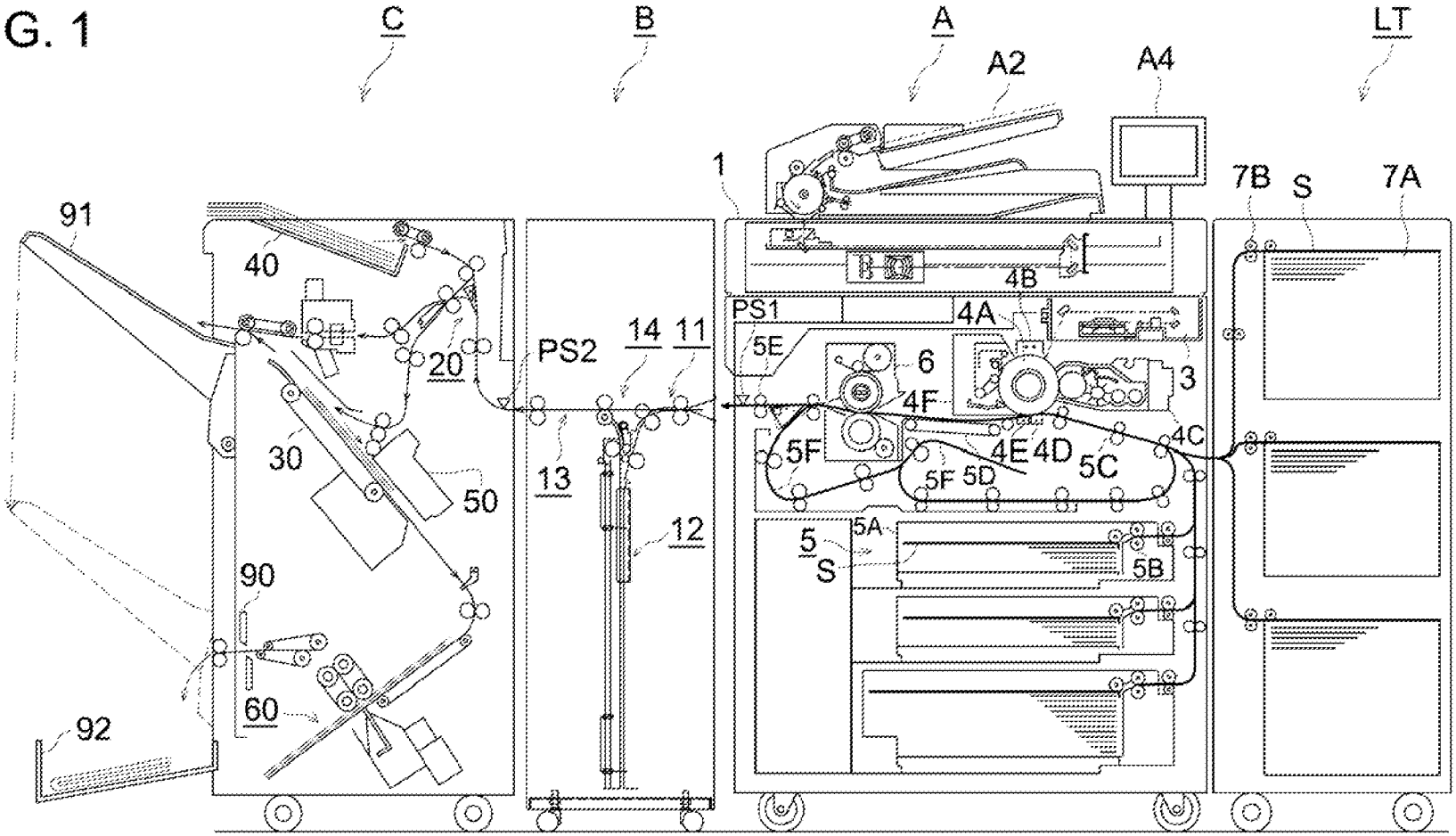
FIG. 1 is an overall structural, diagram of an image forming system having therein image forming apparatus A, intermediate conveying apparatus B, post-processing apparatus C and large capacity sheet feeder LT.

FIG. 1 is an overall structural diagram of an image forming system having therein image forming apparatus A, intermediate conveying apparatus B, post-processing apparatus C and large capacity sheet feeder LT. The intermediate conveying apparatus B is connected between the image forming apparatus A and the post-processing apparatus C.

[Image Forming Apparatus A]

The illustrated image forming apparatus A is equipped with image reading section 1, image writing section 3, image forming section 4, sheet supply conveying section 5, fixing unit 6, automatic document feeding apparatus A2 and operation display section A4.

The image forming section 4 is composed of photoconductor drum 4A, charging section 4B, developing section 4C, transfer section 4D, separation section 4E and cleaning section 4F.

The sheet supply conveying section 5 is equipped with sheet supply cassette 5A, first sheet supply section 5B, second sheet supply section 5C, conveying section 5D, sheet ejection section 5E and automatic double-face copy sheet supply unit (ADU) 5F.

The operation display section A4 is equipped with a touch panel wherein a touch screen is overlapped on a display section composed of a liquid crystal panel. By operation display section 2, various operation screens can be displayed, and types of post processing or type information of sheet to be stored in sheet supply cassette 5A can be inputted.

Images on one face or both faces of a document placed on a document table of automatic document feeding apparatus A2 are read by an optical system of image reading section 1, then, analog signals acquired, through photoelectric transduction are sent to image writing section 3 after processing of analog processing, A/D conversion, shading correction and image compression processing.

In the image writing section 3, photoconductor drum 4A of image forming section 4 is irradiated with output light emitted from a semiconductor laser, and a latent image is formed thereon. On the image forming section 4, processes for charging, exposure, developing, transfer, separation and cleaning are conducted.

An image is transferred onto the sheet S conveyed (supplied) by the first sheet supply section 5B by transfer section 4D. The sheet S onto which an image has been transferred is fixed by fixing unit 6, and is fed into intermediate conveying apparatus B from sheet ejection section 5E. Or, sheet S having an image on its one face that is fed into automatic double-face copy sheet supply unit 5F is subjected again to double-face image processing in image forming section 4, and is ejected by sheet ejection section 5E to be fed into intermediate conveying apparatus B.

PS1 represents a sheet passage detection sensor, and it detects the number of times of sheet conveyance (the number of sheets) from image forming apparatus A to intermediate conveying apparatus B, by detecting existence or nonexistence of a sheet by a sensor of an optical type.

[Large Capacity Sheet Feeder LT]

Large capacity sheet feeder LT is composed of sheet stacking section 7A and first sheet supply section 7B. A large quantity of sheets S including A4 size and A3 size can be stored in the sheet stacking section 7A. Sheets S stored in the sheet stacking section 7A are fed continuously into image forming apparatus A.

[Intermediate Conveying Apparatus B]

Intermediate conveying apparatus B is composed of sheet carry-in section 11, intermediate storing section 12, sheet carry-out section 13 and bypass conveying section 14. The intermediate conveying apparatus B is independent of the image forming apparatus A and of post-processing apparatus C, and it can conduct printing operation under the structure including only the image forming apparatus A and the post-processing apparatus C. For the image forming system constituted of the image forming apparatus A and of the post-processing apparatus C, the intermediate conveying apparatus B can be added later for the purpose of improving productivity on the post-processing apparatus. In the intermediate conveying apparatus B, plural sheets conveyed from the image forming apparatus A can be superposed in the intermediate storing section 12, and a plurality of sheets superposed can be conveyed to subsequent post-processing apparatus C as one set. The intermediate conveying apparatus B will be described in detail later.

[Post-Processing Apparatus C]

In the post-processing section C, there are arranged in tandem almost vertically from the upper step in the illustration, insertion sheet feeding section 40 storing insertion sheets (to be used for a cover sheet or a back cover sheet), stacking section 30, stapling section 50 and folding section 60. In the vicinity of the folding section 60, cutting section 90 that cuts a fore edge of a saddle-stitched, booklet is arranged. Incidentally, in the present embodiment, the post-processing section C is equipped with a cutting section. However, it is also possible to arrange so that a booklet is cut by the use of a general purpose cutting machine separately after ejecting a booklet.

Entrance conveying section 20 is arranged at the upper portion on the right side in an illustration of the post-processing section C. On the left side on an illustration of the post-processing section C, there are arranged movable sheet ejection tray 91 that corresponds to printing jobs for ejecting printed sheets as they are and for stacking them without conducting post-processing, and fixed sheet ejection tray 92 on which saddle-stitched, bound booklets are stacked.

When conducting staple processing, plural sheets on which images are formed are stacked on stacking section 30. On the stapling section 50, staple processing (binding processing) is conducted on the sheet stacked on the stacking section 30.

PS2 is a sheet passage detection sensor that detects the number of times of sheet conveyance (the number of sheets) from intermediate conveying apparatus B to post-processing apparatus C by detecting existence or nonexistence of a sheet with a sensor of an optical system.

Figure 2:
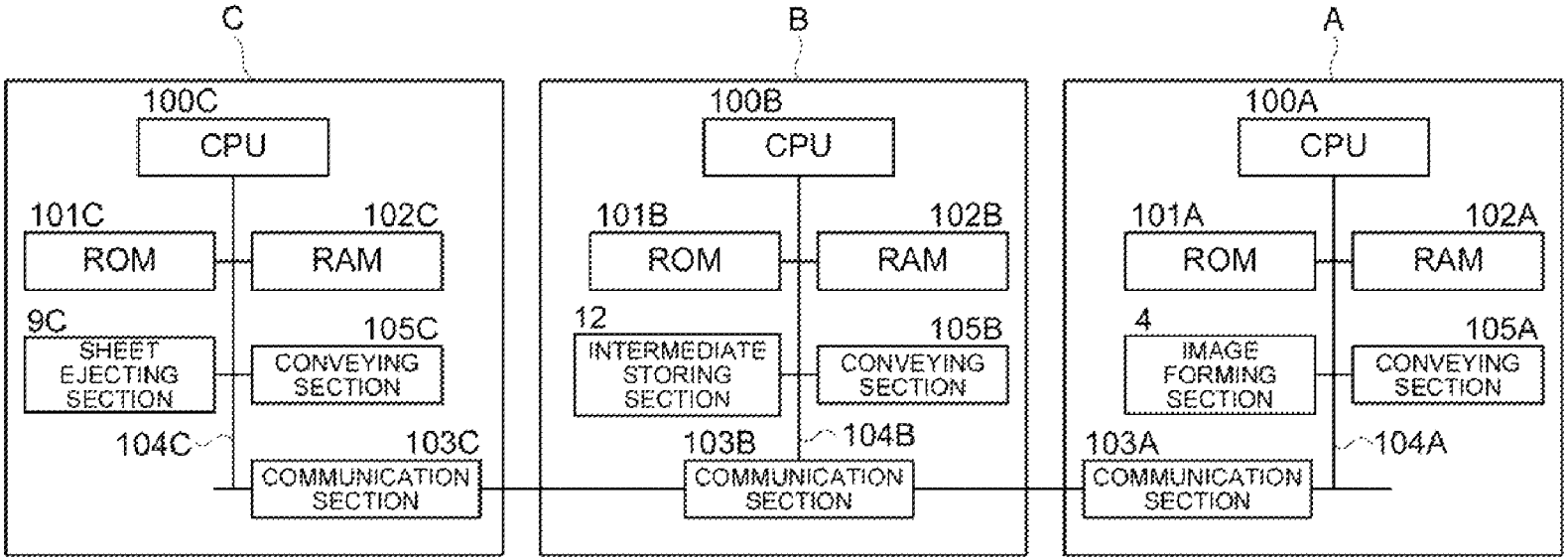
FIG. 2 is a block diagram of a control, system in an image forming system.

FIG. 2 is a block diagram of a control system in an image forming system. Incidentally, in FIG. 2, a description is given by focusing on the periphery of the portion that is necessary for description of operations of the present embodiment, and other known portions as an image forming system are omitted. In figures thereafter, the same symbols are given to common portions, instead of giving descriptions to prevent duplication.

In intermediate conveying apparatus B, Reference numeral 100B represents CPU that conducts various types of controls of the intermediate conveying apparatus B following the program. Reference numeral 101B represents ROM that stores various programs and data including programs and data for controlling intermediate conveying apparatus B. Reference numeral 102B represents RAM serving as a storing section, and it is utilized by CPU100B as a work area to store temporarily programs and data which are necessary when CPU100B controls the intermediate conveying apparatus B.

Then, CPU100B functions as a conveyance control device, and controls the intermediate conveying apparatus B based on programs and data loaded on RAM102B.

Reference numeral 103B is a communication section that functions as a communication device, and it is connected to communication section 103A of image forming apparatus A and to communication section 103C of post-processing apparatus C. The 103B conducts transmission and reception between itself and image forming apparatus A for various data such as information of sizes of sheets conveyed from the image forming apparatus, information of the number of sheets to be outputted and post-processing information. Reference numeral 104B represents a bus through which ROM 101B, RAM 102B and communication section 103B are connected mutually. Reference numeral 105B represents a conveying section that conveys sheets by controlling operations of a driving motor and a conveyance path switching solenoid.

Reference numerals 100A-105A of image forming apparatus A and reference numerals 100C-105C of post-processing apparatus C correspond respectively to 100B-105B of intermediate conveying apparatus B, and they have similar functions.

[Intermediate Conveying Apparatus]

Figure 3:
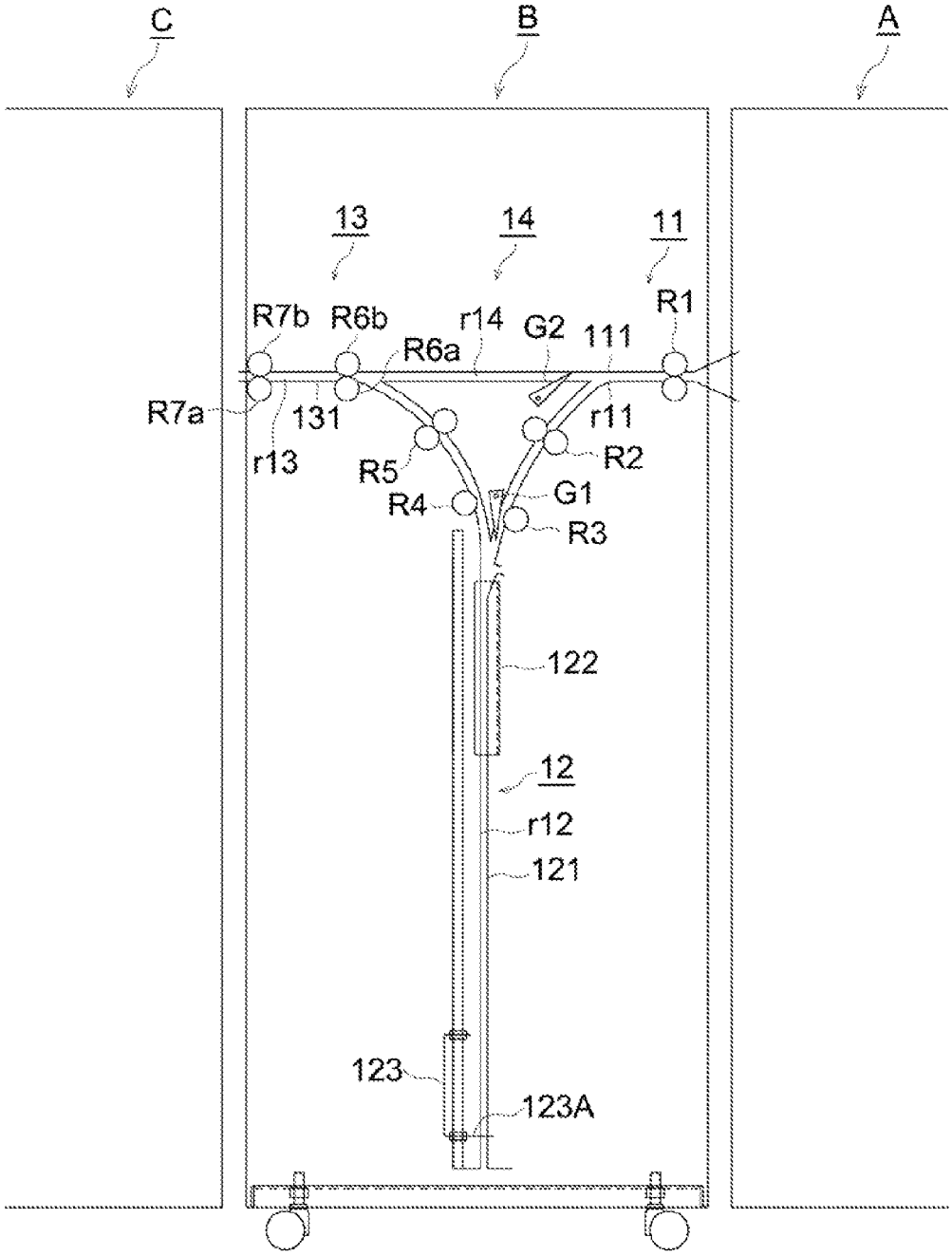
FIG. 3 is a front sectional view of intermediate conveying apparatus B.
Figure 4:
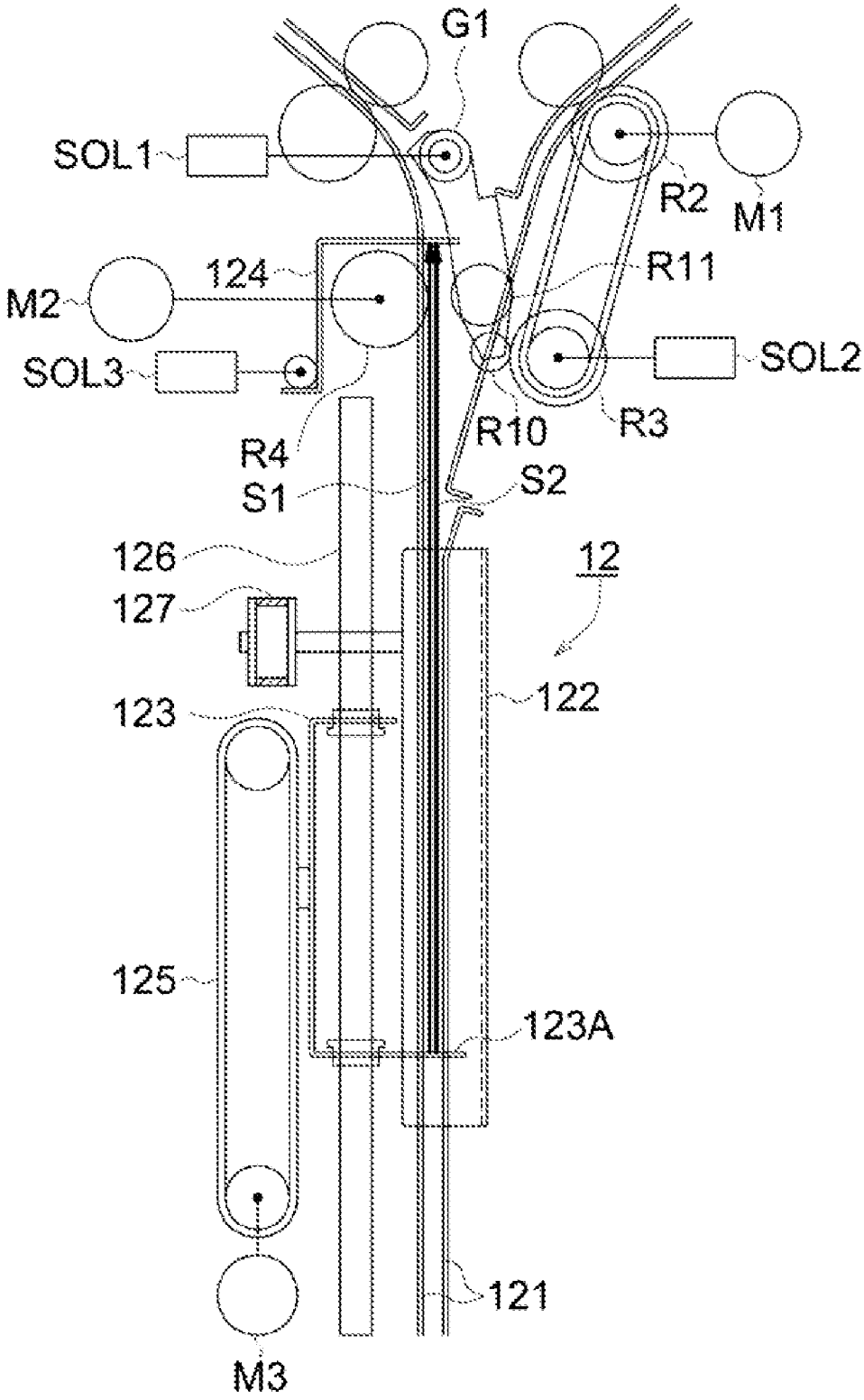
FIG. 4 is a sectional view showing a driving device in the periphery of intermediate storing section 12 of intermediate conveying apparatus B.

Sheets superposing operations at the intermediate conveying apparatus B will be described as follows, based on FIGS. 3 and 4, FIG. 3 is a front sectional view of an intermediate conveying apparatus, and FIG. 4 is a sectional view showing a driving device around intermediate storing section 12 of intermediate conveying apparatus 3.

The intermediate conveying apparatus B is composed of sheet carry-in section 11, intermediate storing section 12, sheet carry-out section 13 and bypass conveying section 14, as stated above.

The sheet carry-in section 11 is equipped with sheet conveyance path r1 that has conveyance rollers R1 and R2 as well as guide plate 111. In the sheet carry-in section 11, sheets S ejected from sheet ejection section 5E of image forming apparatus A are received in succession to be conveyed.

Intermediate storing section 12 is equipped with two guide plates 121 arranged to be in parallel with each other, a longitudinal aligning section having stopping member 123 and longitudinal aligning member 124, lateral aligning section 122, carry-in drive roller R3, carry-out drive roller R4 and sheet conveyance path r12. In the intermediate storing section 12, plural sheets S received from sheet carry-in section 11 are ejected upward, after being stored under the state of being superposed and aligned.

Sheet carry-out section 13 is equipped with sheet conveyance path r13 having therein intermediate conveying roller R5, paired sheet ejection rollers (paired conveying rollers) R6 and R7 and guide plate 131. In the sheet carry-out section 13, plural sheets S stored in the intermediate storing section 12 are reversed in the state of superposition, to be conveyed to subsequent post-processing apparatus C.

Bypass conveyance section 14 is equipped with sheet conveyance path r14. Conveyance of the sheet to the bypass conveyance section 14 is conducted when conveyance to the intermediate storing section 12 is not needed. For example, conveyance of the sheet to the bypass conveyance section 14 is conducted when post-processing of a sheet is not needed, or when sheets are conveyed under the set condition where an interval between sheets is broad enough, such as in non-continuous printing.

Conveyance path switching section G2 arranged at sheet carry-in section 11 is controlled to select connection to either one of bypass conveyance path 14 and intermediate storing section 12. On the upper portion of the intermediate storing section 12, conveyance path switching section G1 is arranged. Introduction of sheet S to the intermediate storing section 12 and ejection of sheet S from the intermediate storing section 12 are switched by the conveyance path switching section G1. Each of the conveyance path switching section G1 and G2 is connected to a solenoid to be driven.

FIG. 4 is a sectional view showing a driving device in a periphery of intermediate storing section 12 of intermediate conveying apparatus B. The conveyance path switching section G1 supporting carry-in follower roller R10 and carry-out follower roller R11 is driven by solenoid SOL1 to swing. Carry-in driving roller R3 is driven by solenoid SOL2 to open and close sheet conveyance path r11. Longitudinal aligning member 124 is driven by solenoid SOL3 to swing.

Motor M1 drives conveyance roller R2 to rotate it, and thereby to rotate carry-in driving roller R3 through a belt. Motor M2 drives carry-out drive roller R4 to rotate it.

Stopping member 123 is hooked on belt 125 rotated by motor M3, and is guided by guide bar 126 to go up and down. A position of the stopping member for being on standby during preparation varies, depending on the length of the sheet to be conveyed in the conveyance direction. Stopping member 123 is caused to be on standby at the lower position such as one in FIG. 3, and under that condition, a plurality of sheets are received to be aligned in vertical and lateral directions, with lateral aligning member 122, longitudinal aligning member 124 and stopping surface 123A of stopping member 123.

As shown in FIG. 4, the stopping member is caused to rise after aligning, and plural sheets are pressed by carry-out drive roller R4 and carry-out follower roller R11 as a set, and an upper portion of one set of superposed sheets (two sheets represented by S1 and S2 in FIG. 4) is pinched. The longitudinal aligning member 124 is driven by an unillustrated solenoid to retreat from sheet conveyance path r13. One set of sheet 51 and sheet S2 pinched by carry-out drive roller R4 and carry-out follower roller R11 is conveyed to sheet carry-out section 13 by rotation of carry-out drive roller R4, and is further pinched by intermediate conveyance rollers R5 to be conveyed to subsequent post-processing apparatus C.

By reversing two or more sheets S superposed through the intermediate storing section 12 of intermediate conveying apparatus B to eject them to the subsequent post-processing apparatus C, it is possible to reverse and conveys the sheets promptly, without requiring stagnant time for sheet reversing and conveying in image forming apparatus A.

Incidentally, the number of sheets S to be stored in the intermediate storing section 12 is not limited to two, and three or more sheets can be superposed. The number of sheets is set by a conveyance control device, in consideration of setting of post-processing in the subsequent post-processing apparatus C.

Figure 5:
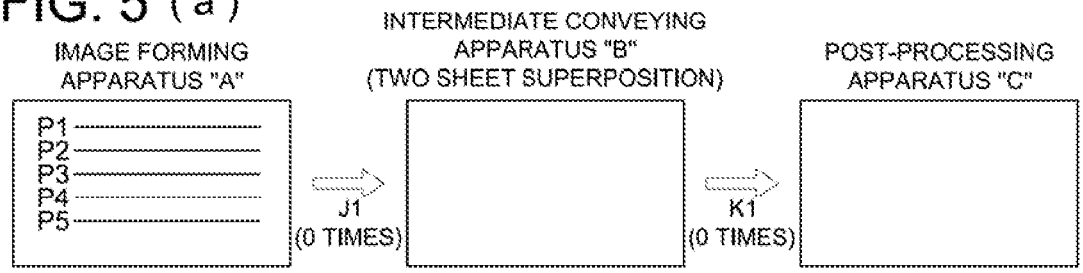
FIGS. 5(*a*)-(*d*) are schematic diagrams illustrating a difference of the number of conveyed sheets in each apparatus that is caused by conveying sheets in which plural sheets are superposed as one set in intermediate conveying apparatus B in the present embodiment.
Figure 5:
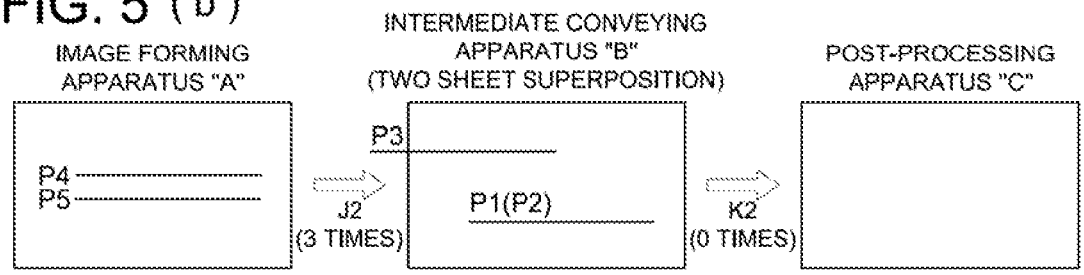
Figure 5:
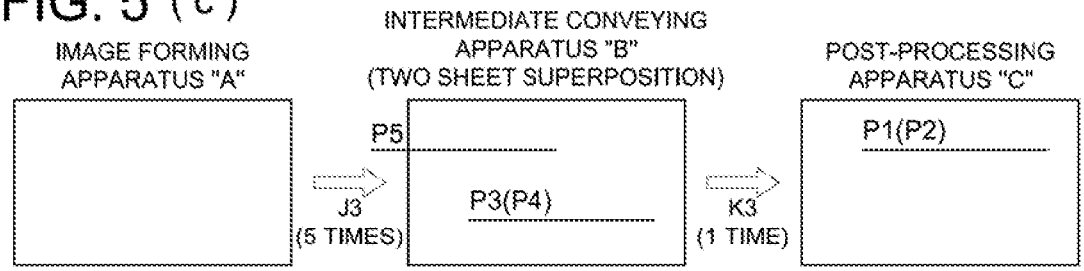
Figure 5:
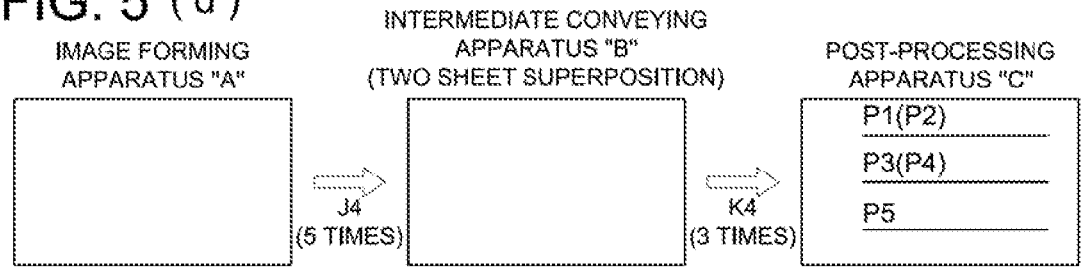

FIG. 5 is a schematic diagram illustrating a difference of the number of conveyed sheets recognized by image forming apparatus A and by post-processing apparatus C that is caused by conveying plural sheets which have been superposed in intermediate conveying apparatus B in the present embodiment to the post-processing apparatus C as one set (which is also called one copy). There will be given by FIG. 5 an explanation for the number of sheets to be conveyed in the case where continuous five sheets are conveyed from image forming apparatus A to post-processing apparatus C through intermediate conveying apparatus B, on the occasion where the number of sheets to be superposed in intermediate conveying apparatus B is set to be two.

In FIG. 5, FIG. 5(*a*)-FIG. 5(*d*) are arranged in the order of time-series basis. Each of J (J1-J4) represents the number of times for conveyance of sheets from image forming apparatus A to intermediate conveying apparatus B (the number of sheets), while, each of K (K1-K4) represents the number of times for conveyance of sheets from Intermediate conveying apparatus B to post-processing apparatus C (the number of sheets). Each of J and K corresponds to the number of times for detection of sheet passage detected by each of PS1 and PS2 in FIG. 1.

FIG. 5(*a*) shows the situation wherein five sheets have not been conveyed to intermediate conveying apparatus B from image forming apparatus A. In this case, the number of times for each of J1 and K1 is 0 (zero) times, because no sheet has passed.

FIG. 5(*b*) shows the situation wherein sheets up to the third sheet among five sheets have been conveyed from image forming apparatus A to intermediate conveying apparatus B. At this point of time, the number of times J2 for conveyance from image forming apparatus A to intermediate conveying apparatus B is three times. The reference numeral K2 remains to be 0 times. Further, at this point of time, the first sheet and the second sheet (P1 and P2) are superposed at intermediate conveying apparatus B.

In FIG. 5(*c*), J3 represents five times because all of five sheets have been conveyed from image forming apparatus A to intermediate conveying apparatus B. Further, though two sheets (P1 and P2) have been conveyed from intermediate conveying apparatus B to post-processing apparatus C, control at intermediate conveying apparatus B is made so that two sheets may be conveyed to subsequent post-processing apparatus C as one set under the condition where the two sheets are superposed, as stated above. Owing to this, the number of times K3 for conveyance from intermediate conveying apparatus B to post-processing apparatus C is one time.

FIG. 5(*d*) shows the situation wherein five sheets have been conveyed totally from intermediate conveying apparatus B to post-processing apparatus C. At this point of time, the third sheet and the fourth sheet (P3 and P4) have been conveyed to post-processing apparatus C as one set under the superposed situation, and the last fifth sheet (P5) has been conveyed to post-processing apparatus C alone. Owing to this, the number of times K4 for conveyance from intermediate conveying apparatus B to post-processing apparatus C is three times.

As shown in the figure, regardless of conveying the same number of sheets from image forming apparatus A to post-processing apparatus C, the number of times J4 for conveyance from image forming apparatus A is five times, and the number of times K4 for conveyance to post-processing apparatus C is three times, and both of them are different each other in terms of a value.

When sheets are conveyed to subsequent post-processing apparatus C after having been superposed at intermediate conveying apparatus B as stated above, the number of times for conveyance from image forming apparatus A (the number of times of sending) and the number of times for conveyance to post-processing apparatus C (the number of times for receiving) do not correspond to each other on a one-to-one correspondence basis. How to control for eliminating the divergence between the number of times of sending and the number of times for receiving with a conveyance control device of intermediate conveying apparatus B will be described as follows.

First Embodiment

Figure 6:
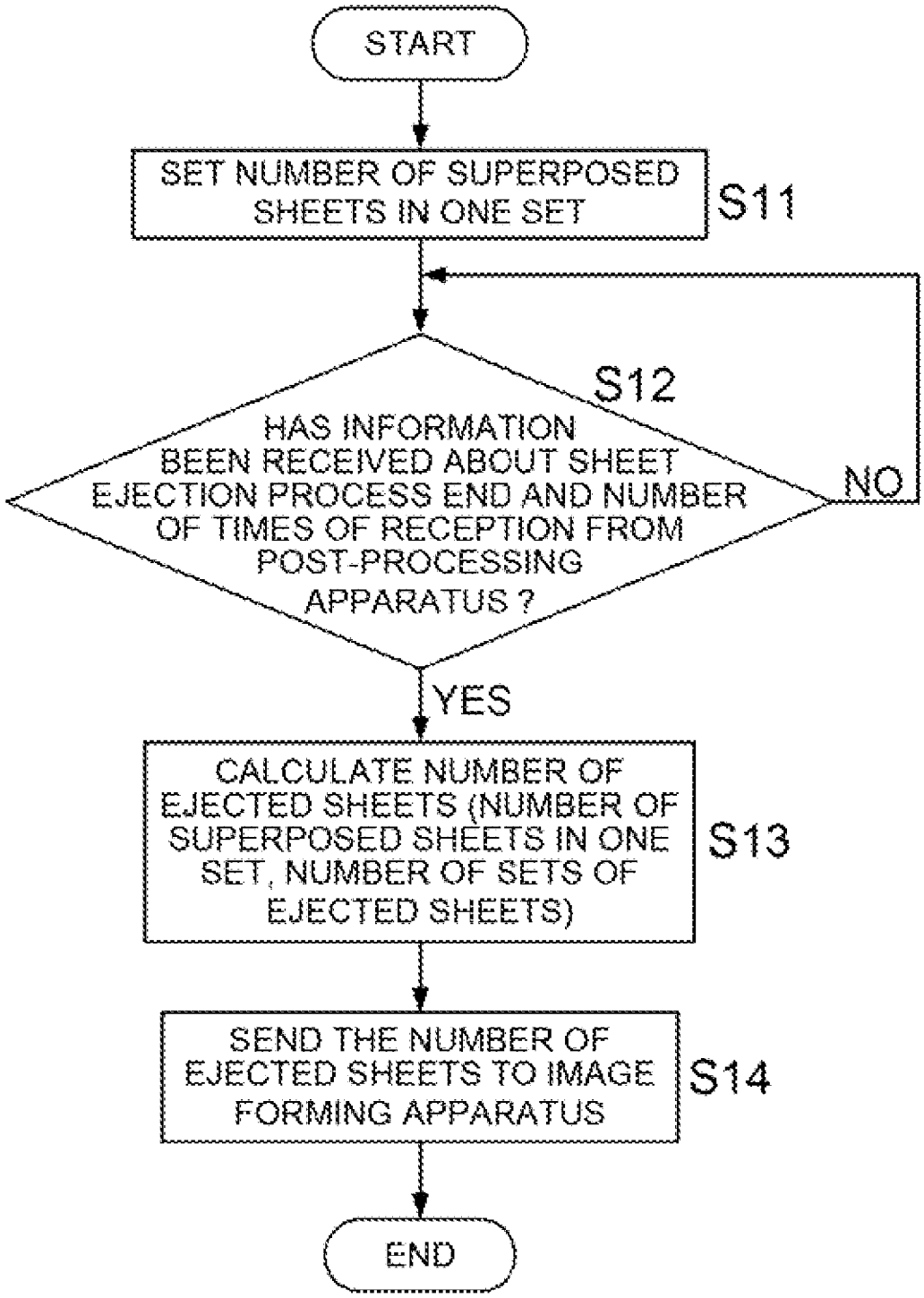
FIG. 6 is a diagram showing a control flow in intermediate conveying apparatus B relating to the first embodiment.

FIG. 6 is a diagram showing a control flow in intermediate conveying apparatus B relating to the First Embodiment. The control flow in FIG. 6 is carried out by CPU 100B that functions as a conveyance control device.

First, in step S11, the number of sheets of one set is set for conducting superposition at intermediate storing section 12. Though this setting is made with a conveyance control device of intermediate conveying apparatus B in consideration of contents of processing by post-processing apparatus C it is also possible to set with operation display section A4 of the image forming apparatus.

In step S12, it is judged whether a notice of sheet ejection processing end and information of the number of times of receiving (information of the number of sets for processing termination) have been received from post-processing apparatus C or not. The sheet ejection processing termination in this case means an occasion where sheets are ejected to sheet ejection tray 91 normally without generating troubles such as sheet conveyance jam in post-processing apparatus C, and the number of times of receiving means the number of times of conveyance to post-processing apparatus C, and it corresponds to the aforesaid K (K1-K4) in FIG. 5.

When the notice of sheet ejection processing end and information of the number of times of receiving are received (step S12: Yes), the number of sheets for sheet ejection processing termination is calculated in subsequent step S13. This is calculated, in principle, by multiplying the number of superposed sheets of one set in step S11 by the number of times of receiving acquired in step S12 (the number of sets terminated in terms of processing). Meanwhile, when the number of sheets in the last set is less than the set number of sheets for one set (corresponding to the fifth sheet in FIG. 5), it is necessary to deduct its shortfall from the value multiplied.

In step S14, information of the number of sheets for sheet ejection processing termination calculated in step S13 is transmitted by communication section 103B to image forming apparatus A. The information of the number of sheets for sheet ejection processing termination in this case corresponds to J (J1-J4) in FIG. 5. In image forming apparatus A, the number of sheets (the number of times) conveyed to subsequent intermediate conveying apparatus B and post-processing apparatus C is compared with the number of sheets for sheet ejection processing termination, whereby, it is possible to judge whether the termination is normal or not.

As stated above, when a conveyance control device of the intermediate conveying apparatus calculates the number of processed sheets based on information of the number of superposed sheets of one set and of the number of processed sets received from the aforesaid post-processing apparatus, and transmits the calculated number of sheets to the aforesaid image forming apparatus, the discrepancy between the number of times of conveyance from image forming apparatus A and the number of times for receiving by the post-processing apparatus C can be eliminated, thus, it is possible to offer an intermediate conveying apparatus capable of decreasing a scale of necessary changes of control I/F (interface).

Second Embodiment

The Second Embodiment is one to control to eliminate the discrepancy between the number of times of conveyance from image forming apparatus A and the number of times for receiving by the post-processing apparatus C, by using page ID (identification) that is corresponding to each of the sheets. This will be described as follows, based on FIG. 7-FIG. 10.

Figure 7:
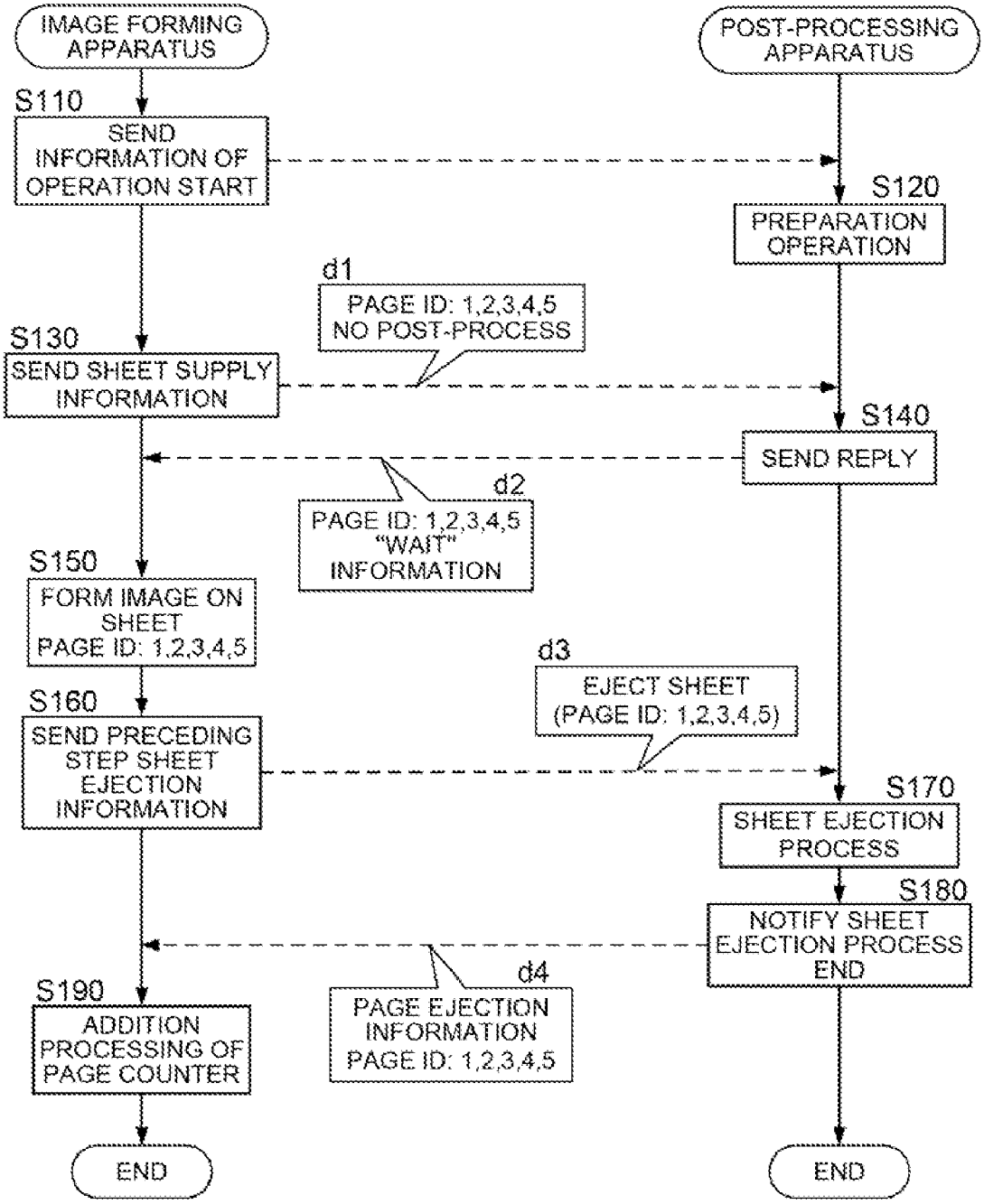
FIG. 7 is a sequence chart of an image forming system having no inter-mediate conveying apparatus B.
Figure 8:
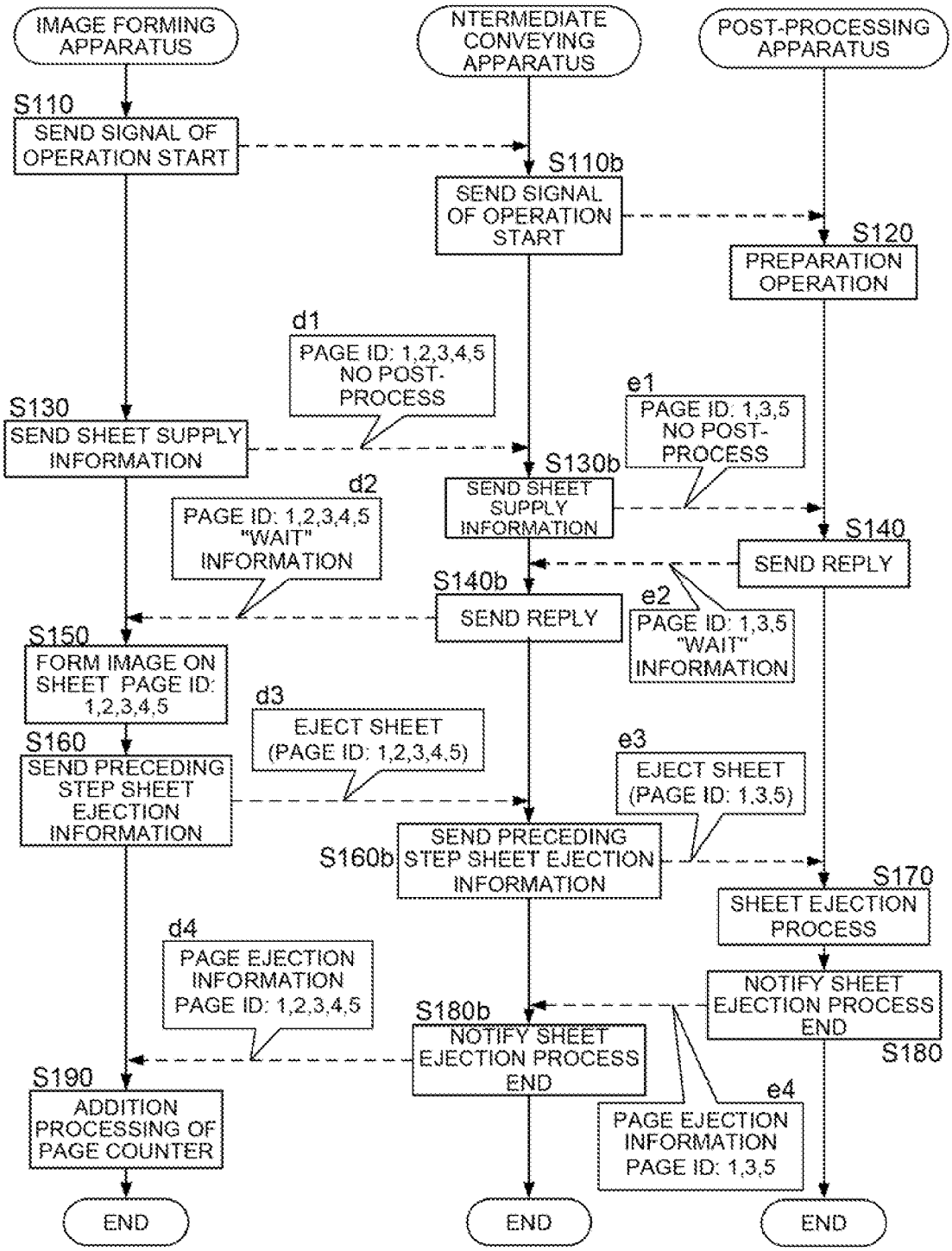
FIG. 8 is a sequence chart of an image forming system having intermediate conveying apparatus B.

FIG. 7 is a sequence chart illustrating a communication sequence of an image forming system having no intermediate conveying apparatus B, and FIG. 8 is a sequence chart illustrating a communication sequence of an image forming system having intermediate conveying apparatus B.

First, the communication sequence between image forming apparatus A and post-processing apparatus C in the image forming system having no intermediate conveying apparatus B will foe described, based on FIG. 7. The control in FIG. 7 is a control sequence that is conducted by control device (100A) of image forming apparatus A and by control device (100C) of post-processing apparatus C through communication sections 103A and 103C.

In step S110, information of operation start is transmitted from image forming apparatus A to post-processing apparatus C. On the post-processing apparatus C that has received the information, preparation operations are carried out (step S120). The preparation operations include an operation to move movable sheet ejection tray 91 of post-processing apparatus C to a predetermined initial position and an operation to check whether staples are in existence in stapling section 50 or not.

In step S130, information of sheet feeding is transmitted. This information includes, for example, page ID and information showing contents of post-processing, as shown in data d1. An example shown in the figure is one wherein five sheets of page ID1-ID5 are subjected to printing without post-processing.

In step S140, a reply for confirmation is sent (step 3140), following data receiving in step S130. In data d2 of this reply, page ID information is included so that normal receiving of data d1 by the post-processing apparatus may be understood. Further, wait information of data d2 represents data describing the time when the sheet corresponding to the sheet feeding information starts to be able to be received.

In step S150, image forming (printing) is conducted on five sheets of page ID1-5 in image forming apparatus A. In step S160, sheet ejection information on the preceding step is transmitted. On the preceding step sheet ejection information d3, there is described that the sheet corresponding to page ID which has been transmitted in step S130 in advance is ejected. According to the preceding step sheet ejection information d3, sheet ejection (conveyance) for five sheets to post-processing apparatus C from image forming apparatus A is conducted.

In step S170, post-processing apparatus C conducts only sheet ejection processing, because "no post-processing" has been set. Post-processing apparatus C transmits a notice of sheet ejection processing end (step S180) after sheet ejection processing is terminated normally.

In image forming apparatus A that has received the notice of sheet ejection processing end, a page counter is subjected to addition processing (step S190) in accordance with descriptive contents of page ejection information d4, to terminate (END). In this case, in image forming apparatus A, it is also possible to display a page counter on operation display section A4, and to change one after another in accordance with addition processing.

The flow shown in FIG. 8 is a communication sequence conducted by conveyance control device (100B) of intermediate conveying apparatus B, control device (100A) of image forming apparatus A and by control device (100C) of post-processing apparatus C, through communication section 103B and communication sections 103A and 103C. It is one showing communication sequence In the case of conducting connection of intermediate conveying apparatus B to apparatuses in FIG. 7, superposing two sheets in intermediate conveying apparatus B and conveying the two sheets to post-processing apparatus C, and controls which are common to those in FIG. 7 are given the same symbols to omit the description.

In step S110*b*, a conveyance control device of intermediate conveyance apparatus B transmits information that is transmitted from image forming apparatus A in step S110 to post-processing apparatus C as it is.

In step S130*b*, sheet feeding information d1 transmitted from image forming apparatus A in step S130 is converted in terms of page ID, after consideration of control wherein plural sheets are superposed at intermediate conveying apparatus B and the superposed sheets are conveyed as one set to the post-processing apparatus. Then, converted sheet feeding information e1 is transmitted to post-processing apparatus C.

Specifically, the first page ID (page ID of the first page) only of each set of plural superposed sheets is transmitted to post-processing apparatus C, by considering existence or nonexistence of superposition of sheets to be conveyed to post-processing apparatus C for each page ID. The first page ID is used as page information to specify a set of superposed sheets. In the example shown in FIG. 8, page ID2 and page ID4 are not described in sheet feeding information e1 because they do not correspond to first page ID of superposed one set because they are superposed with page ID1 and page ID3 respectively.

In step S140*b*, reply (data e2) received from post-processing apparatus C in step S140 is confirmed whether it is the same as sheet feeding information e1 transmitted in step S130*b* or not. After the confirmation, page ID identical to sheet feeding information d1 that corresponds to sheet feeding information e1 is transmitted to image forming apparatus A as sheet feeding information d2. Further, with respect to wait information of data e2, if it is acceptable even for intermediate conveying apparatus B, wait information of data e2 is transmitted as it is as data d2.

In step S160*b*, page ID of the preceding step sheet ejection information d3 sent from image forming apparatus A in step S160, is subjected to conversion similar to that in step S130*b*, and then, it is transmitted to post-processing apparatus C as the preceding step sheet ejection information e3.

In step S180*b*, conversion that is opposite to the conversion conducted in Steps S130*b* and S160*b* is conducted for page ID of page ejection information e4 received after sheet ejection processing termination at steps S170 and S180. Specifically, page ID which is not page ID representing a forefront of one set of plural sheets superposed and conveyed to post-processing apparatus C is added. In the example shown in the figure, page ID2 and page ID4 are added (returned) in page ejection, information d4 for page ejection information e4 with respect to control for adding the page ID, the detailed description will be given again by referring to FIGS. 9 and 10 which will be described later.

The remainder of the steps is terminated by carrying out the processing in step S190. As stated above, it is possible to conduct conveyance control in image forming apparatus A and in post-processing apparatus C, independently of existence of connection, to them, of intermediate conveying apparatus B that superposes plural sheets and conveys them without necessity of consciousness of the connection, by changing properly page ID that is transmitted or received. As is apparent from actual comparison between data d1-d4 in FIG. 7 and data d1-d4 in FIG. 8, both of them are controlled by a conveyance control device so that both of them may become to be the same. Therefore, in image forming apparatus A, it is not necessary to change the control concerning to the number of sheets to be conveyed resulting from additional connection of intermediate conveying apparatus B.

Figure 9:
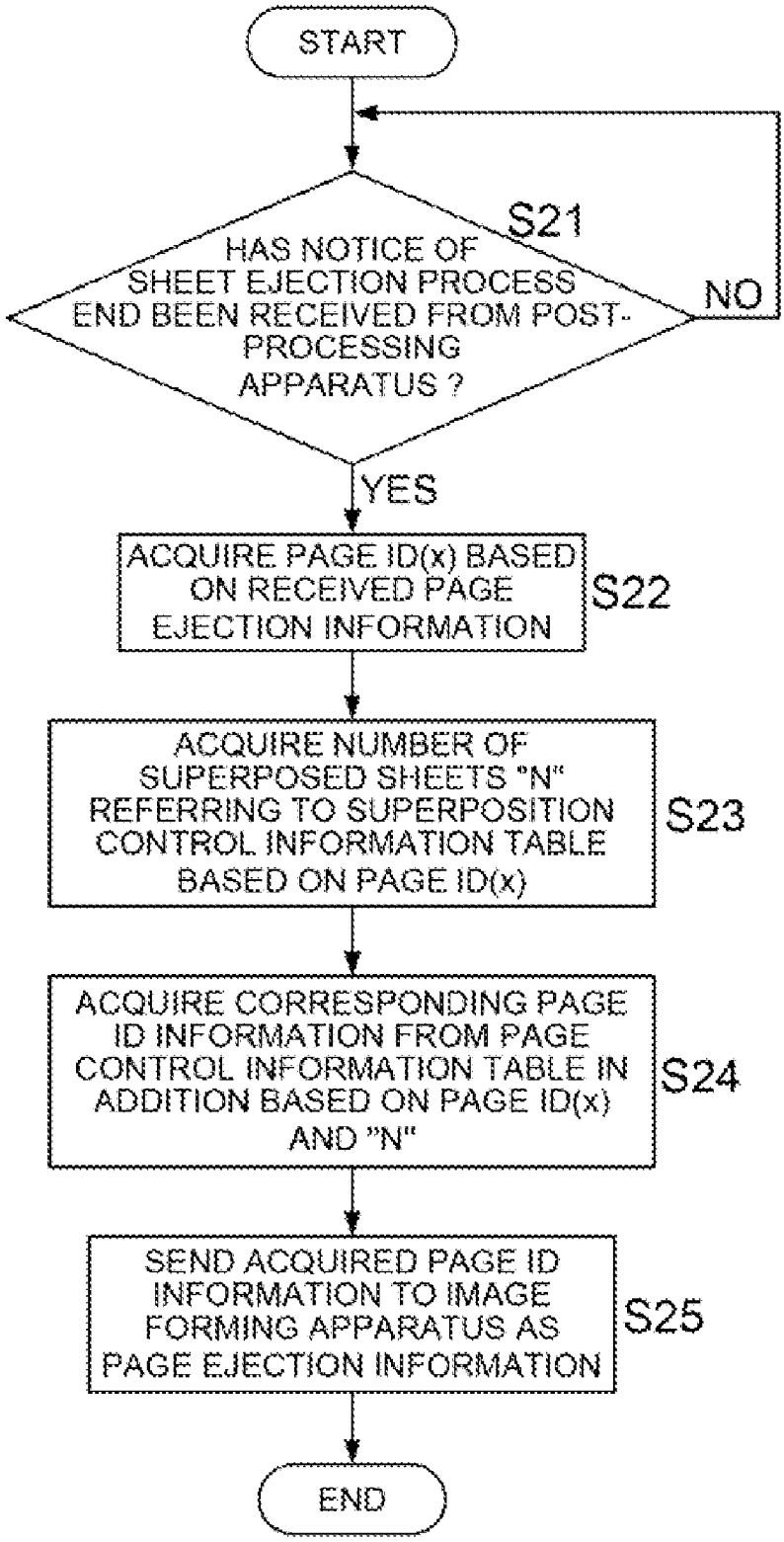
FIG. 9 is a diagram showing a control flow in intermediate conveying apparatus B relating to the second embodiment.

FIG. 9 is a diagram showing a control flow in intermediate conveying apparatus B relating to the second embodiment. Referring to FIG. 9, detailed description about the control mainly around step S180*b* in FIG. 8 will be given.

First, in step S21, it is judged whether a notice of sheet ejection processing end has been received from a post-processing apparatus or not. The notice of sheet ejection processing end means page ejection information e4 in FIG. 8. When it has been received (step S21: Yes), page ID (x) included in the received page ejection information e4 is obtained. In the example shown in FIG. 8, page ID (x) represents page ID1, page ID3 and page ID5.

In step S23, number of superposed sheets N is obtained by page ID (x) by referring to a superposition control information table. In this case, FIG. 10 is an illustration of a control information table that is controlled by a conveyance control device of intermediate conveying device B, and a control flow for the remainder of steps including step S23 and thereafter will be described, referring to FIG. 10(*a*).

A page control information table and a superposition control information table in FIG. 10 are those controlled by a conveyance control device and are stored in RAM 102B that functions as a storing section. The "page control information table" is prepared by sheet feeding information d1 that is received from image forming apparatus A in FIG. 8. The "superposition control information table" is one prepared in the case of transmitting sheet feeding information e1 to post-processing apparatus C based on the sheet feeding information d1.

FIG. 10(*a*) is one showing the situation immediately before receiving a notice of sheet ejection processing end in FIG. 8 (step S180). At this point of time, when page ID1 is received (symbol q1) as page ejection information e4, as shown in FIG. 10(*a*), number of superposed sheets N described in a column of page ID1 on the superposition control information table is obtained (step 323). In the example shown in FIG. 10(*a*), an expression of N=2 holds (symbol q2).

In step S24, corresponding page ID information is obtained from page ID (x) (=page ID1) and a page control table by N (=2) acquired in steps S22 and S23. Specifically, a page control table is traced for a length (range of symbol q4) equivalent to N (=2) sheets from a portion (symbol q3) corresponding to page ID1 of page control table, and page ID information included in that range is obtained. In the example shown In the figure, a page to be added is page ID2.

As is shown in FIG. 10(*b*), page 1D4 to be added is obtained through the same processing even for page ID3. When the number of sheets superposed is one as is shown in FIG. 10(*c*), received page ID and page ID to be transmitted are the same as each other, because there is no page to be added.

Further, data of page control information table corresponding to page ID that has been referred and obtained as well as of superposition control information table become unnecessary, whereby, the data are controlled to be eliminated. As a result, the number of data for two information tables are reduced on a time series basis as shown in FIGS. 10(*a*), 10(*b*) and 10(*c*).

In step S25, page ID information obtained in step S22 and step S24 are transmitted to image forming apparatus A as page ejection information. Page ejection information transmitted in the present step represents page 1D1-page ID5 in FIGS. 10(*a*), 10(*b*) and 10(*c*) as well as in FIG. 8.

Incidentally, though there has been described an example wherein first page ID of a set of sheets to be superposed is transmitted and received sis page information specifying a set of sheets, in FIG. 8, the invention is not limited to this, and it is also possible to transmit and receive page ID of the last page between the image forming apparatus and post-processing apparatus C as page information that specifies a set of sheets. Further, as page information, it is also possible to give a control number to each set of sheets separately, and thereby to use the control number as page information specifying a set of sheets, without using page ID.

As stated above, when the conveyance control device controls so that the number of processed sheets and page IDs of the corresponding sheets may be transmitted to image forming apparatus A, by controlling page ID corresponding to sheets conveyed from the image forming apparatus on a one-to-one correspondence basis and by controlling page information of the first sheet of respective sets of sheets superposed in the aforesaid intermediate storing section, the divergence for the number of times of conveyance from image forming apparatus A as well as the page IDs of the sheets and the number of times for receiving by post-processing apparatus C as well as the page IDs of the sheets can be eliminated, and an intermediate conveying apparatus can be provided wherein a scale of necessary changes of control I/F (interface) can be decreased.

Third Embodiment

What is related to control in the case of carrying out post-processing that processes a set of superposed sheets as one bundle will be described as Third Embodiment. The Third Embodiment is the Second Embodiment wherein information of post-processing termination is further controlled. Though the stapling process will be described as an example of post-processing, the punching process or the saddle stitching process may also be an example without being limited to the stapling process.

Figure 11:
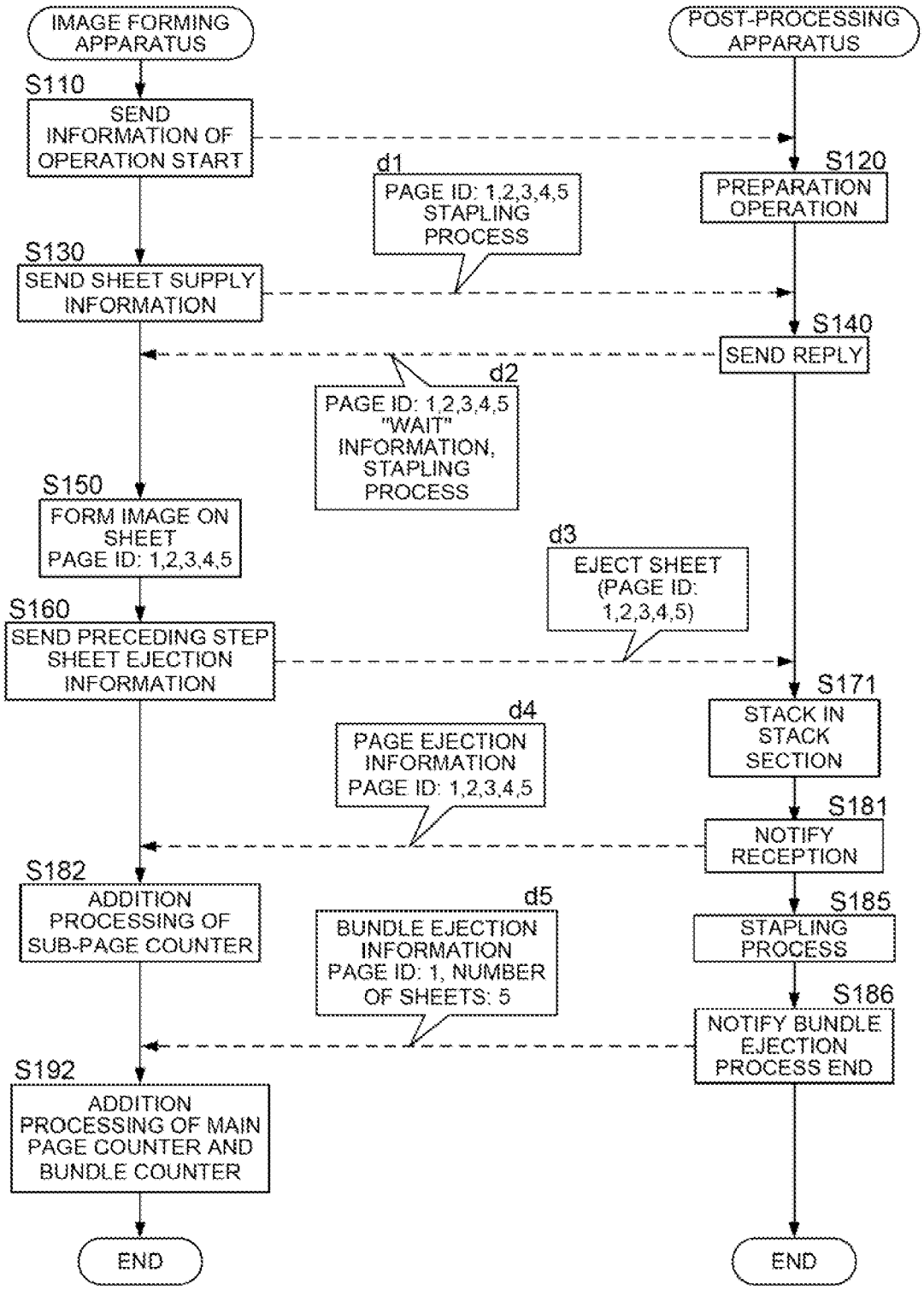
FIG. 11 is a sequence chart of an image forming system having no intermediate conveying apparatus B in the case of conducting staple processing.
Figure 12:
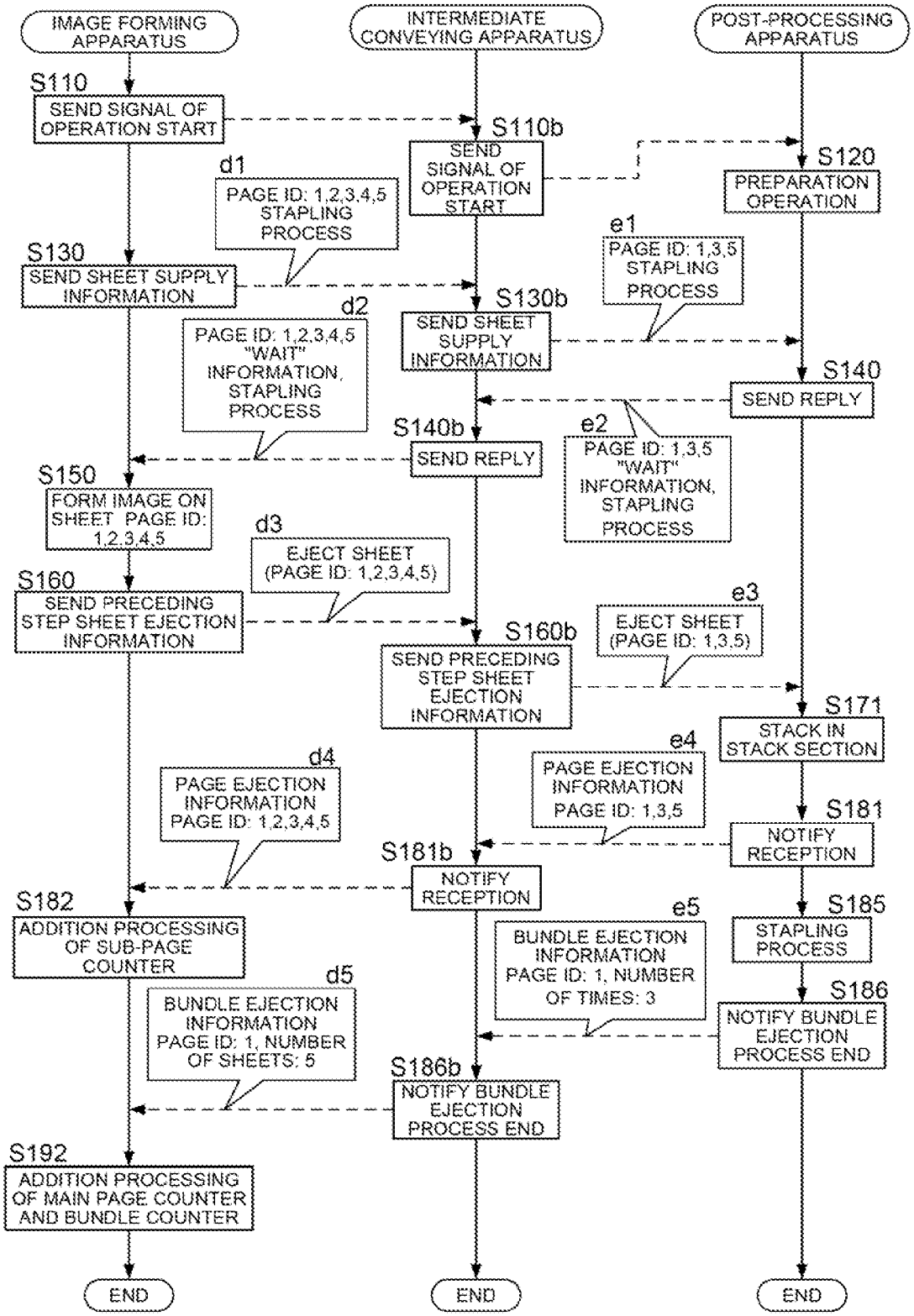
FIG. 12 is a sequence chart of an image forming system having intermediate conveying apparatus B in the case of conducting staple processing.

The description will be given, referring to FIG. 11-FIG. 14. FIG. 11 and FIG. 12 correspond respectively to FIG. 7 and FIG. 8, and each of FIG. 11 and FIG. 12 shows a sequence chart in the case of carrying out the stapling process as a post-processing mode for each of FIG. 7 and FIG. 8. Controls which are common to those in FIG. 7 and FIG. 8 are given the same symbols, and descriptions for them are omitted.

As shown in FIG. 11, each of data d1 and data d2 has thereon a description of being planned to practice the stapling process as information indicating contents of post-processing (hereinafter referred to as post-processing information). Since the processes in step 5160 and before it are common to those in FIG. 7, descriptions for them will be omitted. In step S171, sheets on which images are formed are stacked on stack section 30 as preparation for practicing stapling process, conforming to post-processing information.

In step S181, corresponding page ID is transmitted as a notice of receiving, each time the sheets are stacked. Conforming to page ejection information in this case, sub-page counter controlled by image forming apparatus A is subjected to addition processing (step S182). The "sub-page counter" in this case is a counter that counts temporarily the number of sheets which are not finished in terms of final post-processing but are finished in terms of image forming processing in image forming apparatus A. When some troubles are caused before the final post-processing, the sub-page counter resets and conducts again image forming processing for the current number of pages counted by the sub-page counter.

In step 185, the sheets whose quantity is equivalent to the prescribed number of sheets are stacked on stacking section 30, and then, are subjected to stapling process at stapling section 50. After the normal termination of this process, a notice of bundle ejection processing end is transmitted to image forming apparatus A (step S186). On the aforesaid notice, there are described the first page ID of a bundle (a bundle of plural sets of superposed sheets) on which the stapling was conducted as bundle ejection information d5 and the number of sheets for the one bundle (the number of times for conveyance). The example shown in the figure indicates that the stapling process was carried out on a bundle having therein five sheets. The first page ID is information used for specifying the corresponding bundle (processing unit), and giving the number of sheets of a bundle is to confirm that the unit of the corresponding processing was terminated normally and to confirm the normal termination by comparing with a value of a sub-page counter when conducting the main-page counter processing to be described below.

In step S192, addition processing of a main-page counter and addition processing of a bundle counter are conducted. The main-page counter in this case is an ordinary counter which is the same as the page counter in step S190 in FIG. 7 in terms of meaning. In this case, a value of a sub-page counter that is added in step S182 is added to a main-page counter, and the sub-page counter is reset after the addition processing in step S192. The bundle counter is one that is also called a post-processing counter, and it is caused to count up each time the post-processing is conducted.

FIG. 12 is one showing communication sequence in the case of conducting the control while connecting intermediate conveying apparatus B to the system in FIG. 11 for superposing two sheets at the intermediate conveying apparatus B to convey them to post-processing apparatus C. Processes in step S185 and after it are procedures identical those in FIG. 11 and FIG. 8, so, the descriptions for them will be omitted.

On bundle ejection information e5 on the point of time of the notice for bundle ejection processing end, there are described first page ID1 of a bundle which has been subjected to stapling and the number of times of conveyance "3" for sheets included in the aforesaid bundle (the number of sheets recognized by the post-processing apparatus C). In step S186*b*, this bundle election information e5 is converted into data of d5 by a conveyance control device of an intermediate conveying apparatus. This conversion will be described based on FIG. 13 and FIG. 14.

Figure 13:
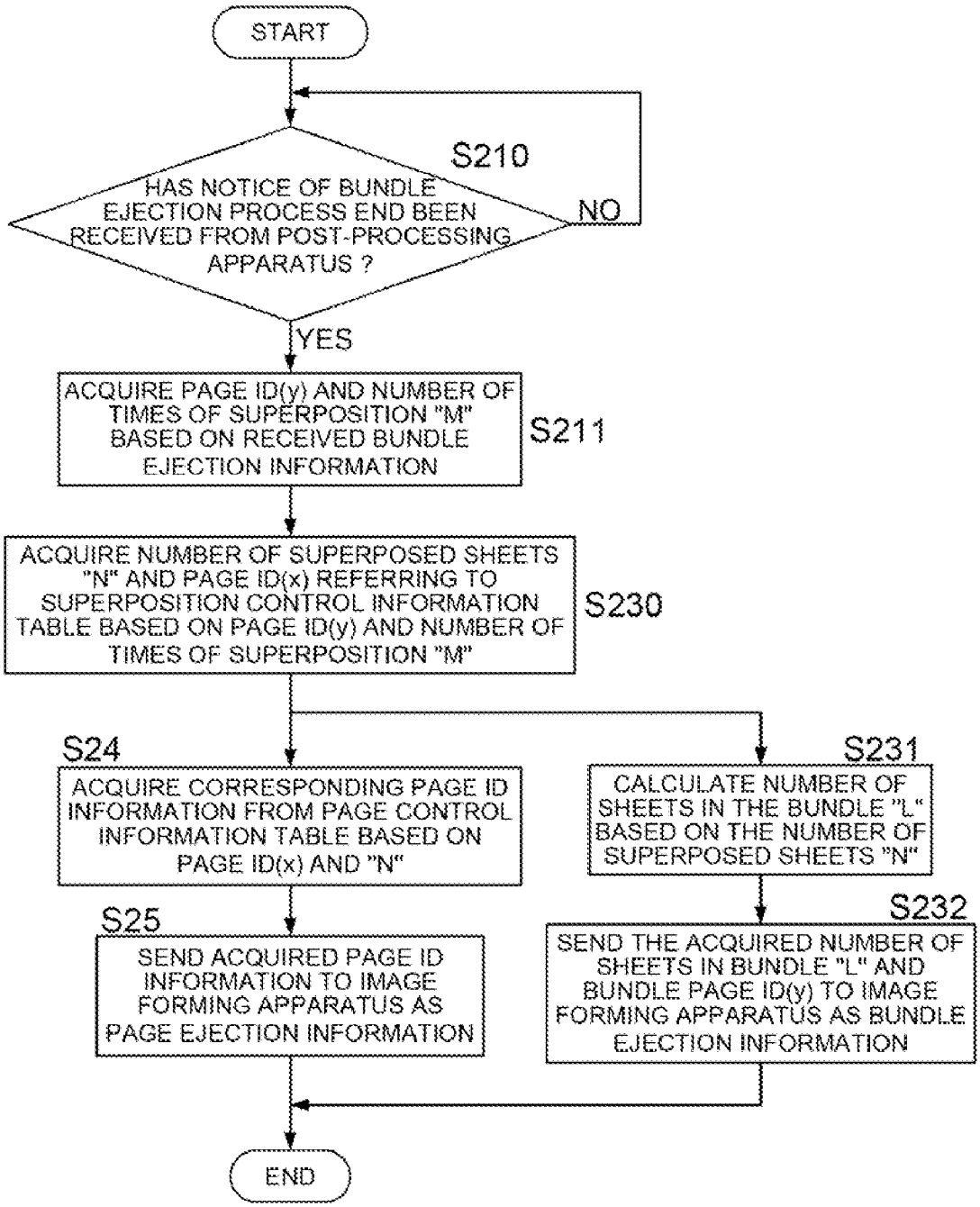
FIG. 13 is a diagram showing a control flow in intermediate conveying apparatus B relating to the third embodiment.

FIG. 13 is a diagram showing a control flow in intermediate conveying apparatus B relating to the third embodiment. Control mainly in the vicinity of step S186*b* and step S181*b* in FIG. 12 will be described in detail, referring to FIG. 13.

First, in step S210, it is judged whether a notice of bundle ejection processing end has been received from the post-processing apparatus or not. The notice of bundle ejection processing end is bundle ejection information e5 in FIG. 12. When it has been received (step 8210; Yes), page ID (y) included in the received bundle ejection information e5 (hereinafter referred to simply as bundle page ID) and the number of times for superposition M are acquired. In the aforesaid example shown in FIG. 12, bundle page ID (y) is page ID1, and the number of times for superposition M is 3.

In step S230, number of superposed sheets N is acquired by using bundle page ID (y) and the number of times for superposition M referring to superposition control information table. A method for referring to will be described by the use of FIG. 14.

FIG. 14 is one exemplifying a control information table, and a bundle control information table shown in FIG. 14 is stored in RAM 102C of post-processing apparatus C. As stated above, the first page ID (y) of a bundle and number of times of superposition M in the bundle control information table have been acquired in step S211. Corresponding page ID (x) and number of superposed sheets N are acquired from the superposition control table by first page ID1 (symbol q12) and the number of times for superposition M (symbol q11) of received bundle. Specifically, the superposition control table is traced for a length equivalent to M (=3) times from a spot (symbol q13) corresponding to page ID1 of superposition control table (range indicated by symbol q14), to acquire the number of superposed sheets H and page ID (x) which are included in the aforesaid traced portion. In the example shown in FIG. 14, the number of superposed sheets N shows 2, 2 and 1, while, page ID (x) shows page ID1, page ID3 and page ID5.

In step S231, the number of sheets in the bundle L is calculated by totaling up all numbers of superposed sheets N corresponding to bundle page ID (y) acquired in step S230. In the example shown in FIG. 14, the L is 5 sheets (2+2+1).

In step S232, the number of sheets in the bundle L calculated in step S231 and bundle page ID (y) are sent to image terming apparatus A as bundle ejection information (d5) to terminate the control (END).

On the other hand, in parallel on the branch flow, page ID information which is acquired from the flow of Steps S24 and S25 by using acquired page ID (x) and the number of superposed sheets N is sent to the image forming apparatus A as page ejection information (d4) to terminate the control (END).

As described above, the conveyance control device controls page ID corresponding to the sheet conveyed from the image forming apparatus on a one-to-one correspondence basis, page information of the first sheet of each set of sheets superposed in the aforesaid intermediate storing section and the state of termination in the post-processing apparatus. By controlling to send the number of sheets finished in terms of processing in the post-processing apparatus and page IDs of the sheets and termination of post-processing to the image forming apparatus A, the conveyance control device can eliminate the divergence between the number of times of conveyance from image forming apparatus A as well as page IDs of the sheets and the number of times of receiving for conveyance to post-processing apparatus C as well as page IDs of the sheets. Therefore, it is possible to offer an intermediate conveying apparatus capable of diminishing a scale of necessary changes of control I/F (interface).

What is claimed is:

1. An intermediate conveying apparatus comprising:

an intermediate storing section configured to superpose a plurality of sheets conveyed from an image forming apparatus, temporarily store the plurality of sheets, and sequentially convey a plurality of sets, wherein one set comprises a superposed plurality of sheets, to a subsequent post-processing apparatus which applies post processing to the plurality of sheets;

a communication device which conducts data communication with the image forming apparatus and the post-processing apparatus; and a conveyance control device which controls conveyance of the sheets, wherein the conveyance control device calculates a total number of the sheets of the plurality of sets for which the post-processing apparatus has completed post-processing by adding a number of the superposed sheets in one set of each of the plurality of sets, based on information about the number of the superposed sheets in the one set of each of the plurality of sets and information about a number of sets of the plurality of sets for which the post-processing apparatus has completed post-processing, wherein the information about a number of sets is received from the post-processing apparatus, and the conveyance control device sends information about the calculated total number of the sheets to the image forming apparatus.

2. The intermediate conveying apparatus of claim 1, wherein the conveyance control device sends the information about the total number of the sheets for which the post-processing has ended and about page IDs of the sheets to the image forming apparatus, by controlling each page ID correlated on a one to one correspondence basis to each sheet of the sheets conveyed from the image forming apparatus and page information which specifies the set of the sheets superposed in the intermediate storing section.

3. The intermediate conveying apparatus of claim 2, wherein the conveyance control device sends and receives the page information between the conveyance control device and the post processing apparatus, wherein the page information specifies the set of the sheets superposed in the intermediate storing section.

4. The intermediate conveying apparatus of claim 2, wherein the page information which specifies the set of the superposed sheets is a page ID of a first page of the set.

5. An image forming system comprising:

an image forming apparatus;

the intermediate conveying apparatus of claim 2; and a post-processing apparatus, wherein the post-processing apparatus can conduct post processing so as to process a plurality of sets of the superposed sheets as one bundle, and when conducting the post-processing so as to process the plurality of sets of the superposed sheets as one bundle, according to conveyance of the sheets to the post-processing apparatus, the conveyance control device sends information about page IDs of the conveyed sheets to the image forming apparatus, and according to an end of the post-processing to the bundle in the post-processing apparatus, the conveyance control device sends a notice of processing end and information about a number of the sheets for which the post-processing has ended and page ID of a first page of the bundle to the image forming apparatus.

* * * * *